US010260378B2

(12) United States Patent
Saltsman

(10) Patent No.: US 10,260,378 B2
(45) Date of Patent: Apr. 16, 2019

(54) SYSTEMS AND METHODS FOR CONTROLLING FLOW VALVES IN A TURBINE

(71) Applicant: GENERAL ELECTRIC COMPANY, Schenectady, NY (US)

(72) Inventor: Joseph Clay Saltsman, Fonda, NY (US)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 198 days.

(21) Appl. No.: 15/280,551

(22) Filed: Sep. 29, 2016

(65) Prior Publication Data

US 2018/0087409 A1 Mar. 29, 2018

(51) Int. Cl.

| | |
|---|---|
| ***F01K 13/02*** | (2006.01) |
| ***F01D 17/14*** | (2006.01) |
| ***F01D 17/20*** | (2006.01) |
| ***F01D 17/24*** | (2006.01) |

(52) U.S. Cl.

CPC ..... *F01K 13/02* (2013.01); *F01D 17/145* (2013.01); *F01D 17/20* (2013.01); *F01D 17/24* (2013.01)

(58) Field of Classification Search

CPC ..... F01K 13/02; F01D 17/145; F01D 17/18; F01D 17/20; F01D 17/24

See application file for complete search history.

(56) References Cited

U.S. PATENT DOCUMENTS

| | | | | |
|---|---|---|---|---|
| 4,002,065 | A * | 1/1977 | Lardi | F01D 17/24 415/16 |
| 4,177,387 | A * | 12/1979 | Malone | F01D 17/24 290/40 R |
| 4,178,763 | A * | 12/1979 | Stern | F01D 17/18 60/660 |
| 4,418,285 | A * | 11/1983 | Podolsky | F01D 17/24 290/40 R |
| 4,556,956 | A | 12/1985 | Dickenson et al. | |
| 4,658,590 | A * | 4/1987 | Higashi | F01K 7/165 415/36 |
| 4,866,940 | A * | 9/1989 | Hwang | F01K 7/165 137/487.5 |

(Continued)

FOREIGN PATENT DOCUMENTS

CN 102607851 B 9/2014

OTHER PUBLICATIONS

International Search Report and Written Opinion issued in connection with corresponding PCT Application No. PCT/US2017/054222 dated May 7, 2018.

*Primary Examiner* — Mark A Laurenzi
*Assistant Examiner* — Xiaoting Hu
(74) *Attorney, Agent, or Firm* — Mintz Levin Cohn Ferris Glovsky and Popeo, P.C.

(57) ABSTRACT

A system for controlling fluid flow in a turbine that includes at least one flow valve configured to regulate fluid intake through the turbine. The system further includes a control system operatively coupled to the at least one flow valve. The control system includes at least one processor configured to receive a percent value flow command. Convert the percent value flow command to a unit value flow command. Determine a unit value stroke command based on the unit value flow command. The processor is further configured to control a position of the at least one flow valve to the unit value stroke command.

14 Claims, 3 Drawing Sheets

(56) References Cited

U.S. PATENT DOCUMENTS

| | | | | |
|---|---|---|---|---|
| 9,158,307 | B2 | 10/2015 | Saltsman | |
| 2006/0067810 | A1* | 3/2006 | Molitor | F01D 17/18 415/1 |
| 2009/0296874 | A1* | 12/2009 | Okuyama | F16K 17/04 376/347 |
| 2011/0283704 | A1* | 11/2011 | Hatamiya | F01K 7/38 60/670 |
| 2014/0338762 | A1* | 11/2014 | Saltsman | G05D 7/0623 137/487.5 |
| 2015/0125257 | A1 | 5/2015 | Meyer et al. | |

* cited by examiner

SYSTEMS AND METHODS FOR CONTROLLING FLOW VALVES IN A TURBINE

BACKGROUND

The field of the disclosure relates generally to rotary machines and, more particularly, to systems and methods for use in controlling flow valves in turbines.

At least some known rotary machines convert steam thermal energy into mechanical rotational energy that is used to power a machine such as an electric generator. For example, known steam turbines typically include a high-pressure (HP) section and/or a reheat or intermediate-pressure (IP) section that each receive high-pressure and high-temperature steam. The steam is channeled through rows of rotor blades or turbine stages to induce rotation of a rotor assembly that is coupled to a load. The flow of steam is typically controlled by at least one flow valve that regulates and controls the steam flow entering the steam turbine.

At least some known steam turbines control power output through use of a control algorithm. A flow command, which is a percent value with 100 percent being full power, is transmitted to a flow-stroke conversion block that outputs a stroke command, also as a percent value. The stroke command is transmitted to a valve position control that selectively positions the flow valve. Within such systems, raw flow-stroke data, measured in pounds-mass per hour (lbsm/hr) for flow rate and inches (in) for valve stroke position, is normalized into a percent value. Because the valve position control receives the stroke command as a percent value, the valve position control requires a valve range to be in a percent value as well.

For at least some known steam turbines, the requirement to convert raw data into percent values may increase the overall complexity, implementation time, and costs associated with system development, commissioning and calibration, and uprating. Moreover, depending on the system, opportunities for calculation errors may be introduced.

BRIEF DESCRIPTION

In one aspect, a system for controlling a fluid flow in a turbine is provided. The system includes at least one flow valve configured to regulate fluid intake through the turbine. The system further includes a control system operatively coupled to the at least one flow valve. The control system includes at least one a processor configured to receive a percent value flow command. Convert the percent value flow command to a unit value flow command. Determine a unit value stroke command based on the unit value flow command. The processor is further configured to control a position of the at least one flow valve to the unit value stroke command.

In a further aspect, a method of controlling fluid flow in a turbine is provided. The method includes receiving a percent value flow command. Converting the percent value flow command to a unit value flow command. Determining a unit value stroke command based on the unit value flow command. The method further includes controlling a position of the flow valve to the unit value stroke command.

In another aspect, at least one non-transitory computer readable storage media having computer-executable instructions embodied thereon is provided. When executed by at least one processor, the computer-executable instructions cause the at least one processor to receive a percent value flow command. Convert the percent value flow command to a unit value flow command. Determine a unit value stroke command based on the unit value flow command. The computer-executable instructions further cause the at least one processor to control a position of the flow valve of a turbine to the unit value stroke command.

DRAWINGS

These and other features, aspects, and advantages of the present disclosure will become better understood when the following detailed description is read with reference to the accompanying drawings in which like characters represent like parts throughout the drawings, wherein.

Figure 1:
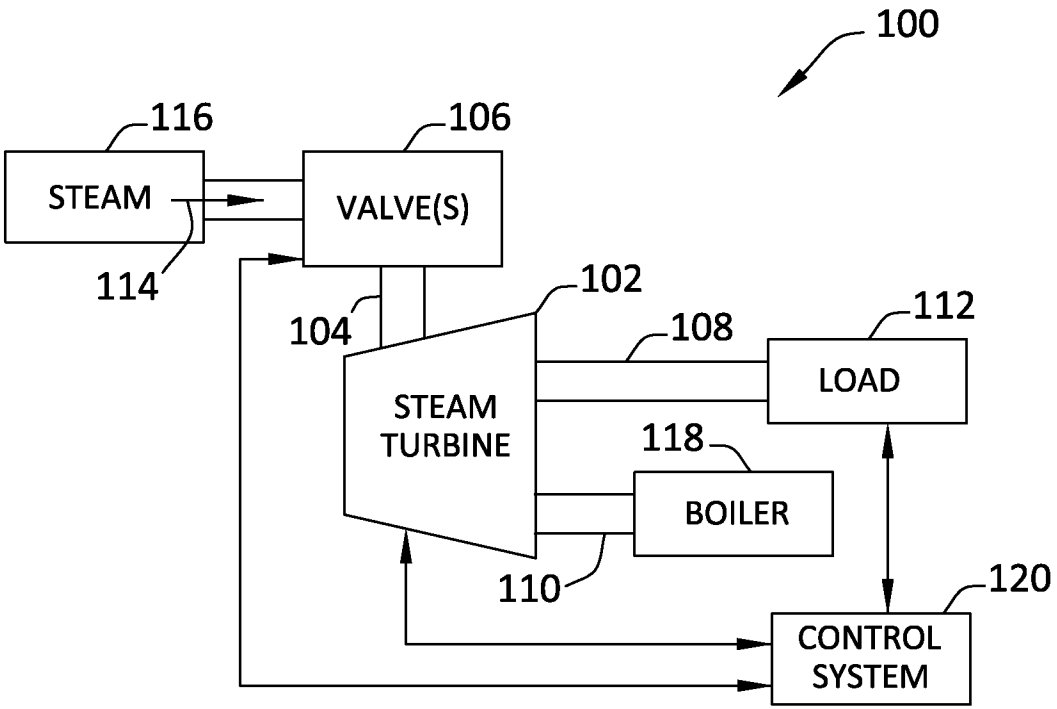
FIG. 1 is a schematic view of an exemplary steam turbine including an exemplary flow valve.

Unless otherwise indicated, the drawings provided herein are intended to illustrate features of embodiments of this disclosure. These features are believed to be applicable in the wide variety of systems comprising one or more embodiments of this disclosure. As such, the drawings are not meant to include all conventional features known by those of ordinary skill in the art to be required for the practice of the embodiments disclosed herein.

DETAILED DESCRIPTION

In the following specification and the claims, reference will be made to a number of terms, which shall be defined to have the following meanings.

The singular forms "a", "an", and "the" include plural references unless the context clearly dictates otherwise. "Optional" or "optionally" means that the subsequently described event or circumstance may or may not occur, and that the description includes instances where the event occurs and instances where it does not. Approximating language, as used herein throughout the specification and claims, may be applied to modify any quantitative representation that could permissibly vary without resulting in a change in the basic function to which it is related. Accordingly, a value modified by a term or terms, such as "about", "approximately", and "substantially", are not to be limited to the precise value specified. In at least some instances, the approximating language may correspond to the precision of an instrument for measuring the value. Here and throughout the specification and claims, range limitations may be combined and/or interchanged, and such ranges are identified and include all the sub-ranges contained therein unless context or language indicates otherwise.

As used herein, the terms "processor" and "computer" and related terms, e.g., "processing device", "computing device", and "controller" are not limited to just those integrated circuits referred to in the art as a computer, but broadly refers to a microcontroller, a microcomputer, a programmable logic controller (PLC), an application specific integrated circuit (ASIC), and other programmable circuits, and these terms are used interchangeably herein. In the embodiments described herein, memory may include, but is not limited to, a computer-readable medium, such as a random access memory (RAM), and a computer-readable non-volatile medium, such as flash memory. Alternatively, a floppy disk, a compact disc-read only memory (CD-ROM), a magneto-optical disk (MOD), and/or a digital versatile disc (DVD) may also be used. Also, in the embodiments described herein, additional input channels may be, but are not limited to, computer peripherals associated with an operator interface such as a mouse and a keyboard. Alternatively, other computer peripherals may also be used that may include, for example, but not be limited to, a scanner. Furthermore, in the exemplary embodiment, additional output channels may include, but not be limited to, an operator interface monitor.

Furthermore, as used herein, the term "real-time" refers to at least one of the times of occurrence of the associated events, the time of measurement and collection of predetermined data, the time to process the data, and the time of a system response to the events and the environment. In the embodiments described herein, these activities and events occur substantially instantaneously.

As used herein, the term "non-transitory computer-readable media" is intended to be representative of any tangible computer-based device implemented in any method or technology for short-term and long-term storage of information, such as, computer-readable instructions, data structures, program modules and sub-modules, or other data in any device. Therefore, the methods described herein may be encoded as executable instructions embodied in a tangible, non-transitory, computer readable medium, including, without limitation, a storage device and/or a memory device. Such instructions, when executed by a processor, cause the processor to perform at least a portion of the methods described herein. Moreover, as used herein, the term "non-transitory computer-readable media" includes all tangible, computer-readable media, including, without limitation, non-transitory computer storage devices, including, without limitation, volatile and nonvolatile media, and removable and non-removable media such as a firmware, physical and virtual storage, CD-ROMs, DVDs, and any other digital source such as a network or the Internet, as well as yet to be developed digital means, with the sole exception being a transitory, propagating signal.

Within the embodiments described herein, a flow command is converted from a percent value to a unit value. The flow command unit value is used to determine a unit value stroke command that controls a position of the flow valve. In some embodiments, the flow valve is calibrated using unit value stroke positions. By using unit values within a control algorithm, rather than normalizing the values to a percent value, system development, commissioning and calibration, and uprating of a steam turbine engine are all facilitated to be simplified.

FIG. 1 is a schematic view of an exemplary steam turbine 100. In the exemplary embodiments, steam turbine 100 is a single-flow steam turbine. In alternative embodiments, steam turbine 100 is an opposed-flow steam turbine. Moreover, the present embodiments are not limited to only being used in connection with steam flow in steam turbines, but rather can be used in connection with any fluid flow through any other rotary machine system, including, but not limited to gas turbines.

In the exemplary embodiment, steam turbine 100 includes a steam turbine assembly 102. Turbine assembly 102 includes an intake section 104 including at least one valve 106, a plurality of rotor blades (not shown) coupled to a rotor assembly 108, and an exhaust section 110. As used herein, the term "couple" is not limited to a direct mechanical, electrical, and/or communication connection between components, but may also include an indirect mechanical, electrical, and/or communication connection between multiple components. Rotor assembly 108 is further coupled to a load 112 such as an electrical generator and/or a mechanical drive application.

During operation, high-pressure and high-temperature steam 114 is channeled from a steam source 116, such as a boiler or the like, through valve 106 and intake section 104. From intake section 104, steam 114 is channeled through turbine assembly 102 where it impacts the rotor blades to convert thermal energy to mechanical rotational energy, thus inducing rotation of rotor assembly 108 and drive load 112. Steam 114 exits turbine assembly 102 via a low pressure exhaust section 110. Steam 114 exhausted from turbine assembly 102 may be further channeled to a boiler 118 for reheating, and/or to other components, for example, a low pressure turbine section or a condenser (not shown).

Further in the exemplary embodiment, steam turbine 100 includes a control system 120 that is coupled to turbine assembly 102, valve 106, and/or load 112. Control system 120 regulates the flow of steam 114 into turbine assembly 102. For example, control system 120 actuates and/or positions valve 106 to regulate the flow of steam 114 into turbine assembly 102.

Figure 2:
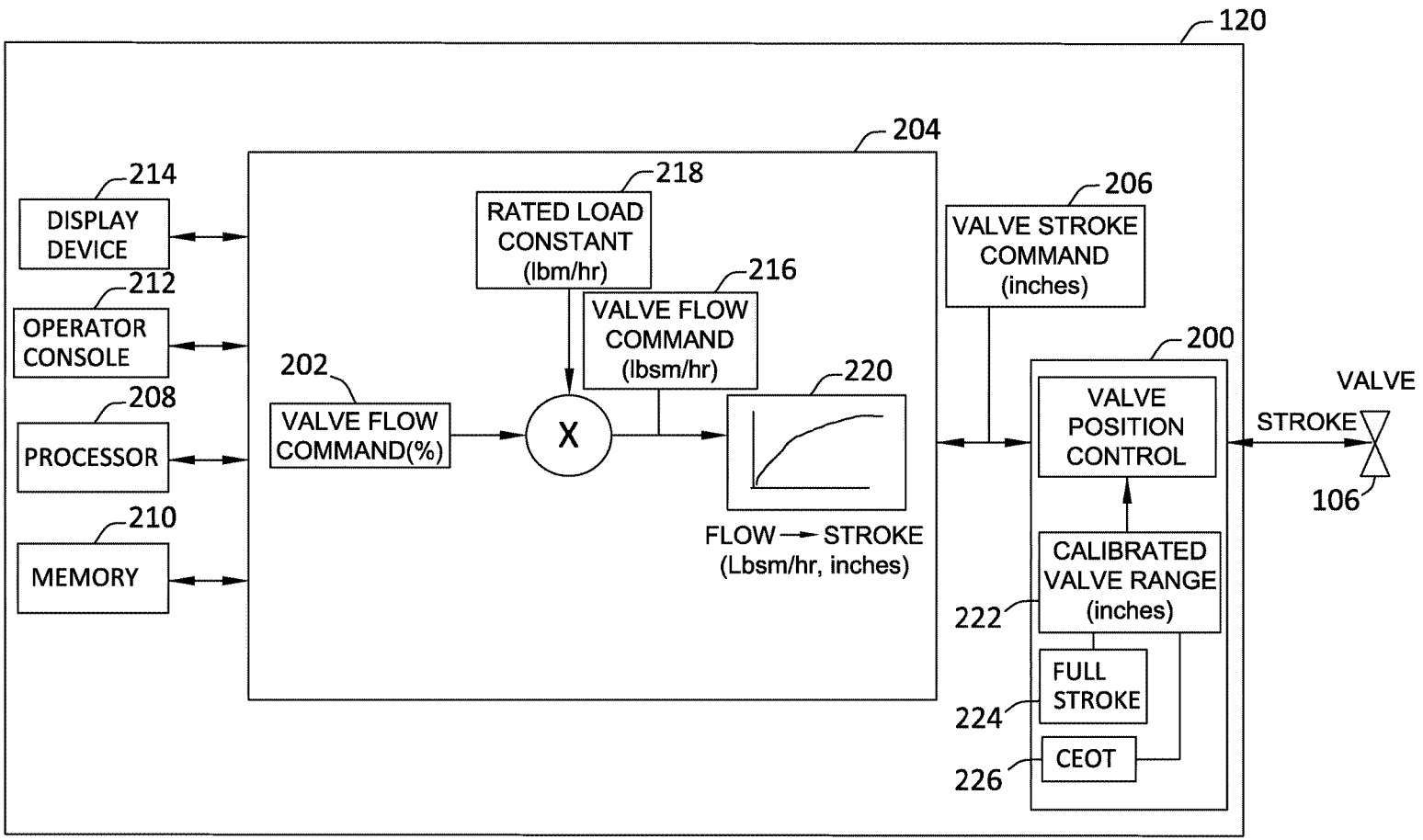
FIG. 2 is a schematic block diagram of an exemplary control system that may be used with the flow valve shown in FIG. 1.

FIG. 2 is a schematic block diagram of control system 120 coupled to steam turbine 100. With reference to FIGS. 1 and 2, in the exemplary embodiment, control system 120 includes a valve controller 200 that is coupled to valve 106 to control a position of or a stroke of valve 106, and thus regulates a flow of steam 114 into steam turbine 100. In certain embodiments, valve controller 200 automatically positions valve 106 in at least one preselected position corresponding to a flow command 202. For example, valve controller 200 is programmed to position valve 106 at a preselected position corresponding to flow command 202 generated by a suitable control algorithm, and the control algorithm adjusts the power generated by steam turbine 100. Additionally or alternatively, valve controller 200 may control valve 106 corresponding to flow command 202 based on operator input. In alternative embodiments, control system 120 does not include valve position controller 200, and valve 106 is positioned manually.

Control system 120 also includes a data processor 204. In the exemplary embodiment, data processor 204 communicates with valve controller 200. More specifically, data processor 204 receives flow command 202 and determines, through programmed instructions, stored as software in a non-transient computer readable medium, control signals that are transmitted to valve controller 200. In the exemplary embodiment, control signals transmitted by data processor 204 to valve controller 200 include at least a stroke command 206. For example, data processor 204 is in communication with a processor 208 that performs one or more executable instructions stored in a memory 210 to process flow command 202 into stroke command 206 for positioning valve 106. In some embodiments, data processor 204 includes an operator console 212 that communicates with data processor 204. For example, data processor 204 receives input from operator console 212 and displays output to a display device 214.

In the exemplary embodiment, a position of valve 106 is controlled by data processor 204 via valve controller 200. To position valve 106, data processor 204 receives flow command 202 from a suitable control algorithm, such that flow command 202 corresponds to the required power for steam turbine 100. Flow command 202 is represented as a nominal percent value. For example, a 100 percent flow command value would represent that steam turbine 100 is operating at full power. Percent value flow command 202 is then converted to a flow command 216 having a unit value. To generate unit value flow command 216, percent value flow command 202 is multiplied by a rated load constant 218 that has a flow unit value of pounds-mass per hour (lbsm/hr). Rated load constant 218 is a predetermined unit value that is received, for example, from a thermodynamic analysis report for steam turbine 100 and that is stored within memory 210.

Further, unit value flow command 216 is converted to a unit value stroke command 206 via a flow-stroke converter 220. In the exemplary embodiment, flow-stroke converter 220 is a data array stored in memory 210 that includes a plurality of unit value flow rates, such as in lbsm/hr, that each correspond to a respective unit value valve stroke position, such as in inches. Generally, the flow values and stroke positions are discrete unit values previously determined from measurements and/or analysis of steam turbine 100. In operation, processor 208 uses flow-stroke converter 220 to interpolate between points in the array and to determine unit value stroke command 206 from unit value flow command 216. Additionally or alternatively, flow-stroke converter 220 may be any other suitable set of flow/stroke data that enables the conversion of unit value flow command 216 to unit value valve stroke command 206. For example, in an alternative embodiment, flow-stroke converter 220 is a flow-stroke curve equation that represents flow vs. stroke for valve 106. Unit value stroke command 206 is transmitted to valve controller 200 to control valve 106 to a position that corresponds to the desired power output for steam turbine 100.

In some embodiments, the unit flow values and corresponding unit stroke position values stored in flow-stroke converter 220 are selectively modified to account for back pressure during operation of steam turbine 100. During operation, excessive steam 114 flowing through intake section 104 and into turbine assembly 102 may cause steam flow 114 to back up and result in increased pressure at valve 106. Modifying the unit flow values and corresponding unit stroke position values stored in flow-stroke converter 220 based on back pressure at valve 106 facilitates the determination of a more accurate flow and stroke position value.

By using unit values within control system 120, such as unit value flow command 216, unit value stroke command 206, and flow-stroke converter 220, the number of calculations required to control valve 106 from flow command 202 are facilitated to be simplified and reduced, as compared to known systems that convert all values to a percentage value. Reducing the number of calculations facilitates reducing the likelihood of conversion errors created as unit values are converted to percentage values, and also reduces valve 106 control development time.

Moreover, in the exemplary embodiment, valve controller 200 receives unit value stroke command 206. As such, a valve calibration 222 is also facilitated to be simplified because valve controller 200 uses unit values. In the exemplary embodiment, valve calibration 222 includes a full stroke value 224 stored as a unit value, such as in inches, and a closed end over travel (CEOT) value 226 stored as a unit value, such as in inches. For example, these values are measured by and/or received from a manufacturer of valve 106. The CEOT value represents a minimum valve position value and the full stroke value represents a maximum valve position value. Valve calibration 222 uses full stroke value 224 and CEOT value 226 to perform valve calibration such that valve calibration 222 represents a range of valve controller 200. As such, valve controller 200 receives unit value stroke command 206 and selectively positions the stroke of valve 106 within the range accordingly. In alternative embodiments, a range of valve controller 200 is determined and/or stored in valve calibration 222 using any other method that enables control system 120 to operate as described herein. Additionally, valve controller 200 may include its own processor (not shown) to perform valve calibration 222.

Moreover in the exemplary embodiment, during an uprate of steam turbine 100 (wherein steam turbine 100 operates at a higher flow rate), control system 120 facilitates a simplified process to re-configure data processor 204 and valve controller 200. In some known turbine uprates, valve 106 is reconfigured to open to a greater extent such that a maximum flow therethrough is increased. For this type of uprate, rated load constant 218 is updated and/or modified, but the data within flow-stroke converter 220 is maintained. As such, only rated load constant 218 is updated, for example, through use of operator console 212. By using unit values within control system 120, data within flow-stroke converter 220 need not be changed, thus simplifying the uprate as compared to systems that use a percentage value that requires the data within flow-stroke converter 220 to be at least periodically updated. Further, in other known turbine uprates, valve 106 receives a new flow-stroke relationship. For this type of uprate, not only will the data within flow-stroke converter 220 be updated, rated load constant 218 and valve calibration 222 are also each updated. By using unit values within control system 120 and not percent values, the uprate is simplified because raw unit values are updated within control system 120, without a need to convert the values to a percent value. Accordingly, in some embodiments, use of unit values to control valve 106 facilitates reducing the number of calculations and thus the likelihood of conversion errors when uprating stream turbine 100, while also reducing valve 106 control development time.

Figure 3:
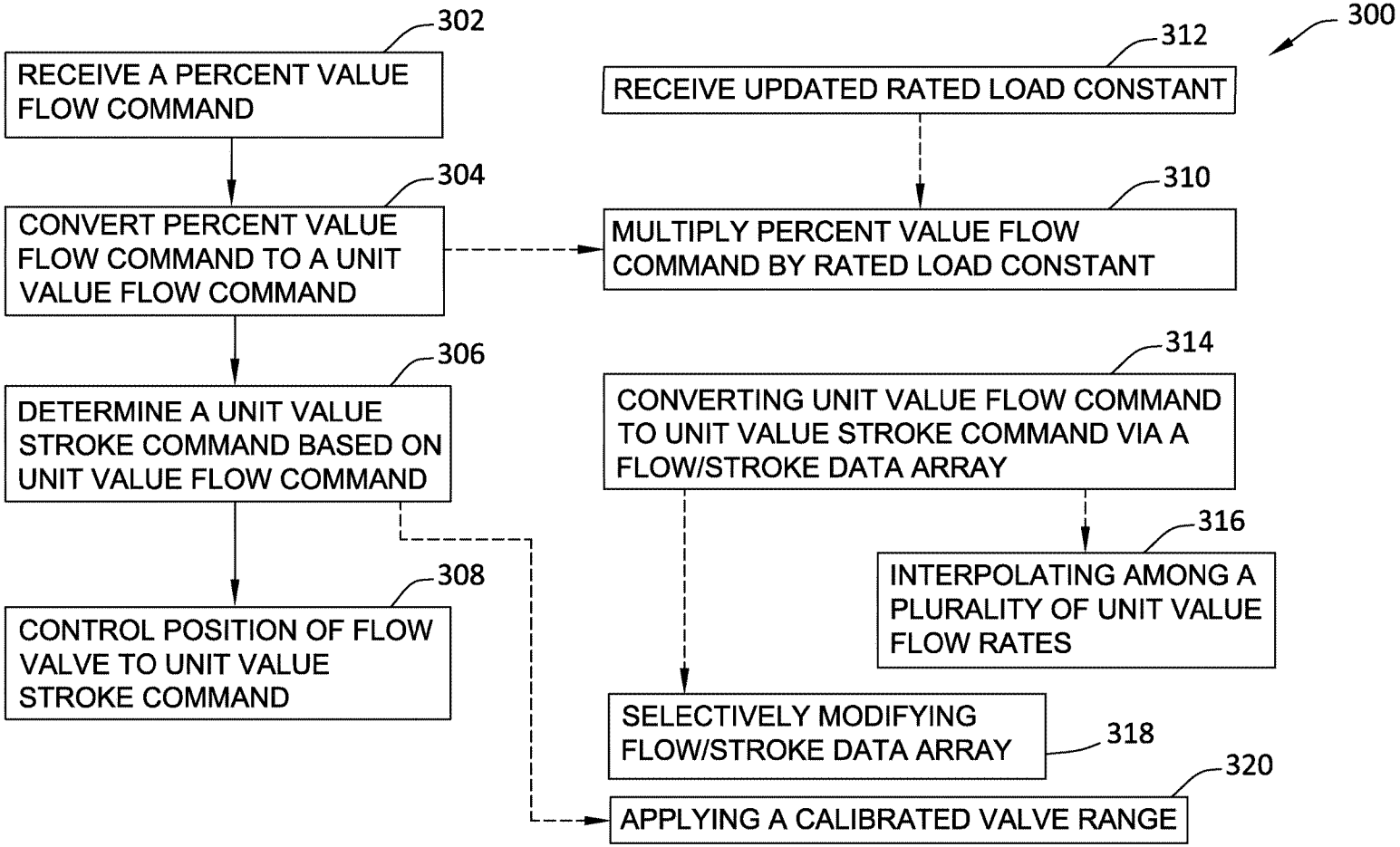
FIG. 3 is a flow diagram of an exemplary method of controlling a fluid flow in a turbine, such as the steam turbine shown in FIGS. 1 and 2.

An exemplary embodiment of a method 300 of controlling fluid flow, such as steam 114 (shown in FIG. 1) in a turbine, such as steam turbine 100 (shown in FIG. 1), is illustrated in a flow diagram in FIG. 3. With reference also to FIGS. 1 and 2, exemplary method 300 includes algorithms and/or instructions stored in a non-transitory machine-readable medium, such as memory 210, and executed, for example, by one or more processors, such as processor 208, within control system 120. Method 300 includes receiving 302 a percent value flow command, such as flow command 202. Converting 304 the percent value flow command to a unit value flow command, such as flow command 216. Determining 306 a unit value stroke command based on the unit value flow command, such as stroke command 206. Method 300 further includes controlling 308 a position of the flow valve to the unit value stroke command.

In some embodiments, converting 304 the percent value flow command to the unit value flow command includes multiplying 310 the percent value flow command by a rated load constant for the turbine, such as rated load constant 218. In other embodiments, method 300 further includes receiving 312 an updated rated load constant, such as during an uprate of steam turbine 100.

In certain embodiments, determining 306 the unit value stroke command includes converting 314 the unit value flow command to the unit value stroke command via a flow/stroke data array, such as interpolating stroke values from known flow and stroke values via flow/stroke converter 220. In other embodiments, the flow/stroke data array includes interpolating 316 among a plurality of unit value flow rates that each correspond to a respective unit value valve stroke position. In some embodiments, method 300 further includes selectively modifying 318 the flow/stroke data array to compensate for turbine back pressure. In other embodiments, determining 306 the unit value stroke command based on the unit value flow command further includes applying 320 a calibrated valve range. The calibrated valve range includes a maximum valve stroke position value defined by a full stroke unit value, such as value 224, and a minimum valve stroke position value defined by a CEOT unit value, such as value 226.

Exemplary embodiments of systems and methods for use in controlling fluid flow in a turbine are described above in detail. Specifically, within the systems and methods described herein, a flow command is converted from a percent value to a unit value. The unit value flow command is used to determine a unit value stroke command that controls a position of the flow valve. In some embodiments, the flow valve is calibrated using unit value stroke positions. By using unit values within a control algorithm, rather than normalizing the values to a percent value, system development, commissioning and calibration, and uprating of a steam turbine engine are all facilitated to be simplified. Simplifying the control algorithm further facilitates reducing the likelihood of calculation errors and also reduces implementation time and costs.

An exemplary technical effect of the methods, systems, and apparatus described herein includes at least one of: (a) simplifying control of a flow valve through use of unit values within the control algorithm; (b) reducing the opportunity for errors in development, commissioning and calibration, as well as uprating; and (c) decreasing implementation time and costs in development, commissioning and calibration, as well as uprating.

The systems and methods described herein are not limited to the specific embodiments described herein. For example, components of each system and/or steps of each method may be used and/or practiced independently and separately from other components and/or steps described herein. In addition, each component and/or step may also be used and/or practiced with other assemblies and methods.

Some embodiments involve the use of one or more electronic or computing devices. Such devices typically include a processor, processing device, or controller, such as a general purpose central processing unit (CPU), a graphics processing unit (GPU), a microcontroller, a reduced instruction set computer (RISC) processor, an application specific integrated circuit (ASIC), a programmable logic circuit (PLC), a field programmable gate array (FPGA), a digital signal processing (DSP) device, and/or any other circuit or processing device capable of executing the functions described herein. The methods described herein may be encoded as executable instructions embodied in a computer-readable medium, including, without limitation, a storage device and/or a memory device. Such instructions, when executed by a processing device, cause the processing device to perform at least a portion of the methods described herein. The above examples are exemplary only, and thus are not intended to limit in any way the definition and/or meaning of the term processor and processing device.

While the disclosure has been described in terms of various specific embodiments, those skilled in the art will recognize that the disclosure can be practiced with modification within the spirit and scope of the claims. Although specific features of various embodiments of the disclosure may be shown in some drawings and not in others, this is for convenience only. Moreover, references to "one embodiment" in the above description are not intended to be interpreted as excluding the existence of additional embodiments that also incorporate the recited features. In accordance with the principles of the disclosure, any feature of a drawing may be referenced and/or claimed in combination with any feature of any other drawing.

What is claimed is:

1. A system for controlling fluid flow in a turbine, said system comprising:

at least one flow valve configured to regulate fluid intake through the turbine; and a control system operatively coupled to said at least one flow valve, said control system comprising an operator console, memory, and at least one processor configured to:

receive a percent value flow command and a rated load constant, the rated load constant comprising a predetermined unit value received from the memory;

convert the percent value flow command to a first unit value flow command by at least multiplying the percent value flow command by the rated load constant of the turbine to obtain the first unit value flow command;

determine a first unit value stroke command based on the first unit value flow command;

control a position of said at least one flow valve using the first unit value stroke command;

receive an updated rated load constant from the operator console;

convert the percent value flow command to a second unit value flow command using the updated rated load constant;

determine a second unit value stroke command based on the second unit value flow command; and control the position of said at least one flow valve using the second unit value stroke command.

2. The system in accordance with claim 1, wherein said at least one processor is further configured to:

convert the first unit value flow command to the first unit value stroke command via a flow/stroke data array; and convert the second unit value flow command to the second unit value stroke command via the flow/stroke data array.

3. The system in accordance with claim 2, wherein the flow/stroke data array includes a plurality of unit values flow rates that each correspond to a respective unit value valve stroke position.

4. The system in accordance with claim 2, wherein said at least one processor is further configured to selectively modify the flow/stroke data array to compensate for turbine back pressure.

5. The system in accordance with claim 1, wherein said at least one processor is further configured to apply a calibrated valve range of said at least one flow valve, the calibrated valve range includes a maximum valve stroke position defined by a full stroke unit value and a minimum valve stroke position value defined by a closed end over travel (CEOT) unit value.

6. A method of controlling fluid flow in a turbine, said method comprising:

receiving a percent value flow command and a rated load constant, the rated load constant comprising a predetermined unit value received from a memory;

converting the percent value flow command to a first unit value flow command by at least multiplying the percent value flow command by the rated load constant of the turbine to obtain the first unit value flow command;

determining a first unit value stroke command based on the first unit value flow command;

controlling a position of a flow valve using the first unit value stroke command;

receiving an updated rated load constant from an operator console;

converting the percent value flow command to a second unit value flow command using the updated rated load constant;

determining a second unit value stroke command based on the second unit value flow command; and controlling the position of the flow valve using the second unit value stroke command.

7. The method in accordance with claim 6, wherein determining the first unit value stroke command comprises converting the first unit value flow command to the first unit value stroke command via a flow/stroke data array, and wherein determining the second unit value stroke command comprises converting the second unit value flow command to the second unit value stroke command via the flow/stroke data array.

8. The method in accordance with claim 7, wherein converting the first unit value flow command to the first unit value stroke command via the flow/stroke data array and converting the second unit value flow command to the second unit value stroke command via the flow/stroke data array each comprise interpolating among a plurality of unit value flow rates that each correspond to a respective unit value valve stroke position.

9. The method in accordance with claim 7, further comprising selectively modifying the flow/stroke data array to compensate for turbine back pressure.

10. The method in accordance with claim 6, wherein determining the first unit value stroke command and determining the second unit value stroke command each further comprise applying a calibrated valve range, wherein the calibrated valve range includes a maximum valve stroke position value defined by a full stroke unit value and a minimum valve stroke position value defined by a closed end over travel (CEOT) unit value.

11. At least one non-transitory computer readable storage media having computer-executable instructions embodied thereon, wherein when executed by at least one processor, the computer-executable instructions cause the at least one processor to:

receive a percent value flow command and a rated load constant, the rated load constant comprising a predetermined unit value received from at least one memory device coupled to the at least one processor;

convert the percent value flow command to a first unit value flow command by at least multiplying the percent value flow command by the rated load constant of the turbine to obtain the first unit value flow command;

determine a first unit value stroke command based on the first unit value flow command;

control a position of a flow valve of a turbine using the first unit value stroke command;

receive an updated rated load constant from an operator console;

convert the percent value flow command to a second unit value flow command using the updated rated load constant;

determine a second unit value stroke command based on the second unit value flow command; and control the position of the flow valve using the second unit value stroke command.

12. The computer-readable storage media in accordance with claim 11, wherein the computer-executable instructions further cause the at least one processor to:

convert the first unit value flow command to the first unit value stroke command via a flow/stroke data array stored in the at least one memory device coupled to the at least one processor; and convert the second unit value flow command to the second unit value stroke command via the flow/stroke data array.

13. The computer-readable storage media in accordance with claim 12, wherein the computer-executable instructions further cause the at least one processor to selectively modify the flow/stroke data array to compensate for turbine back pressure.

14. The computer-readable storage media in accordance with claim 11, wherein the computer-executable instructions further cause the at least one processor to apply a calibrated valve range of the flow valve, the calibrated valve range including a maximum valve stroke position defined by a full stroke unit value and a minimum valve stroke position value defined by a closed end over travel (CEOT) unit value.

* * * * *